US005751107A

United States Patent [19]

Komatsu

[11] Patent Number: 5,751,107

[45] Date of Patent: May 12, 1998

[54] FIELD-DISCHARGE FLUORESCENT-DISPLAY WITH FLUORESCENT LAYER INCLUDING GLASS

[75] Inventor: Hiroshi Komatsu, Suwa, Japan

[73] Assignee: Seiko Epson Corporation, Tokyo, Japan

[21] Appl. No.: 560,519

[22] Filed: Nov. 17, 1995

Related U.S. Application Data

[63] Continuation of Ser. No. 129,206, Nov. 3, 1993, abandoned, which is a continuation of PCT/JP93/00167, Feb. 2, 1993.

[51] Int. Cl.[6] ..... H01J 1/62

[52] U.S. Cl. ..... 313/496

[58] Field of Search ..... 313/495, 496, 313/497, 467, 486, 553, 561, 309, 351, 310, 336; 65/154, 32.2, 34, 59.1; 445/25, 24, 43

[56] References Cited

U.S. PATENT DOCUMENTS

| | | | |
|---|---|---|---|
| 3,603,661 | 9/1971 | Detro | 445/43 |
| 3,916,245 | 10/1975 | Dorf et al. | 313/486 |
| 4,001,629 | 1/1977 | Thayer | 313/517 |
| 4,125,390 | 11/1978 | Kawai et al. | 65/34 |
| 5,015,912 | 5/1991 | Spindt et al. | 313/495 |
| 5,055,227 | 10/1991 | Yoneshima et al. | 252/301.65 |
| 5,063,327 | 11/1991 | Brodie et al. | 313/482 |
| 5,136,207 | 8/1992 | Miyake et al. | 313/486 |
| 5,223,766 | 6/1993 | Nakayama et al. | 313/495 |

FOREIGN PATENT DOCUMENTS

| | | | |
|---|---|---|---|
| 46-19791 | 6/1971 | Japan . | |
| 51-9678 | 1/1976 | Japan | H01J 5/22 |
| 51-162654 | 12/1976 | Japan . | |
| 58-10291 | 2/1983 | Japan | H01J 29/86 |
| 2-177234 | 7/1990 | Japan | H01J 9/39 |

OTHER PUBLICATIONS

K. Betsui, "Fabrication and Characteristics of Si Field Emitter Arrays", Technical Digest of IVMC 91, Nagahama 1991, pp. 26–29. no month.

J. Itoh et al., "Metal-Film-Edge Field Emitter Array With A Self-Aligned Gate", Technical Digest of IVMC 91, Nagahama 1991, pp. 46–47. no month.

C.A. Spindt et al., "Physical Properties Of Thin-Film Field Emission Cathodes With Molybdenum Cones", Journal of Applied Physics, vol.47, No. 12, Dec. 1976, pp. 5248–5263.

R. Meyer, "6" Diagonal Microtips Fluorescent Display for T.V. Applications", Euro Display 1990, pp. 374–377. (no month).

R. Meyer, "Recent Development on 'Microtips' Display at LETI", Technical Digest of IVMC 91, Nagahama 1991, pp. 6–9. (no month).

(List continued on next page.)

*Primary Examiner*—Michael Horabik
*Assistant Examiner*—Michael Day
*Attorney, Agent, or Firm*—Oliff & Berridge, PLC

[57] ABSTRACT

A fluorescent display apparatus performs a desired display by, in a vacuum state, irradiating its fluorescent layer with electrons discharged from electric-field electron discharge devices. The fluorescent layer is formed by a fluorescent substance and low-fusing-point glass, serves as an adhesive agent for the fluorescent substance. Paste obtained by mixing, for example, fluorescent substance powder, low-fusing-point glass powder and a binder is applied to a substrate or the like, followed by sintering at a temperature higher than the fusing point of the low-fusing-point glass. Solder is used to seal the space in the apparatus. An exhaust port is placed on a frame in a vacuum chamber while making the exhaust port face downwards. Then, spherical solder disposed between the frame and the foregoing exhaust port is heated and melted to be injected into the exhaust port. In order to raise the degree of vacuum, getter material is formed on the inner surface of the foregoing space to have a thin film shape. The getter material is irradiated with laser beams to be vaporized and activated after air in the foregoing space has been exhausted and the space has been sealed up.

22 Claims, 11 Drawing Sheets

OTHER PUBLICATIONS

Charles A. Spindt et al, "Field–Emitter Arrays Applied to Vacuum Fluorescent Display", IEEE Transactions on Electron Devices, vol. 36, No. 1, Jan., 1989, pp. 225–228.

Ivor Brodie, "Advanced technology: flat cold–cathode CRTs", Information Display, Jan. 1989, pp. 17–19. (no month).

Physics for Scientists and Engineers, 1982, pp. 246, 247 (no month).

FIELD-DISCHARGE FLUORESCENT-DISPLAY WITH FLUORESCENT LAYER INCLUDING GLASS

This is a Continuation of application Ser. No. 08/129,206 filed Nov. 3, 1993, now abandoned, which in turn is a continuation of PCT/JP93/00167 filed Feb. 2, 1993.

BACKGROUND OF THE INVENTION

1. Field of the Invention

The present invention relates to a fluorescent display apparatus such as a light-emission-type character display for use as a display of, for example, clocks, meters mounted on a vehicle, OA equipment and various other information guide displays or a small-size matrix display utilized in a view-finder of a cam corder, and more particularly to a fluorescent display apparatus for performing display by irradiating a fluorescent layer with electrons discharged from an electric-field electron discharge device to perform a desired display, a method of forming a fluorescent layer of the apparatus, a method of sealing vacuum in the space of the apparatus and a method of raising the degree of vacuum.

2. Description of Related Arts

Recently, a fluorescent display apparatus of the foregoing type has been suggested that has an electric-field electron device to serve as the electron source for irradiating the fluorescent layer thereof with electrons to perform a display (for example, see Technical Digest of IVMC91).

FIG. 22 illustrates an example of a fluorescent display apparatus of the foregoing type constituted such that a conductive cathode electrode 102 is formed on a device substrate 101 made of glass or the like. A gate electrode 104 is formed on the cathode electrode 102 while interposing an insulating layer 103 therebetween. Further, a substantially-conical electric-field electron discharge device (microtip) 105 is, in an opening formed in the insulating layer 103 and the gate electrode 104, disposed on the cathode electrode 102. An anode electrode 107 made of ITO or the like is formed on the lower surface of an opposing substrate 106 disposed above the device substrate 101 and is made of glass or the like, and a fluorescent layer 108 is formed on the lower surface of it at a position above the foregoing electric-field electron discharge device 105.

A vacuum is formed in a portion between the foregoing electric-field electron discharge device 105 and the fluorescent layer 108, that is, in space S between the foregoing two substrates 101 and 106, and voltage of a predetermined level is applied to the cathode electrode 102, the gate electrode 104 and the anode electrode 107. As a result, electrons are caused to discharge from the leading portion of the conical electric-field electron discharge device 105 to irradiate the fluorescent layer 108 so that a desired display is performed.

The conventional structure having the foregoing fluorescent layer 108 is formed simply by causing fluorescent substance powder to adhere to the lower surface of the anode electrode 107 where it is held by only Van der Waals force. Therefore, problems arise, for example, in that, if the electric-field electron discharge device 105 and the fluorescent layer 108 are made to come closer to each other than about 50 μm in order to improve the resolution or to reduce the thickness, the electrostatic attraction force is made stronger than the Van der Waals force, causing the fluorescent layer to be separated from the surface of the anode electrode. Accordingly, a structure for high-speed electron beams has been suggested in which a conductive thin film made of Al or the like is formed on the surface of the fluorescent layer. However, the foregoing structure cannot be adapted to low-speed electron beams because electrons cannot penetrate the foregoing conductive thin film.

In order to form a vacuum in the foregoing space S, the conventional structure has been arranged, for example, as shown in FIG. 23 such that an exhaust port 109 is formed in the substrate 106, which is one of the two substrates. Further, a glass pipe 110 is fastened to the outer surface of the exhaust port 109 to suck and exhaust air in the space S between the two substrates 101 and 106 through the glass pipe 110 to make a vacuum in the space. Then, the glass pipe is sealed up to seal the vacuum state. However, the glass pipe excessively projects over the substrate after the glass pipe has been sealed up so that thickness and size reductions are hindered. In particular, if the conventional structure is adapted to a display of a watch or the like, there is a fear that the layout encounters a problem. Further, high temperature (about 1000° C.) is applied at the time of sealing up the glass pipe, resulting in gas release. The released gas is introduced into the foregoing space, causing a problem to take place in that the degree of vacuum is lowered.

It has been known to use getter material to raise the degree of vacuum. For example, a conventional fluorescent display tube has been constituted as shown in FIGS. 24A and 24B so that a getter material, constituted by enclosing mixture powder 112 of $BaAl_4$ and Ni into an annular metal container 111 made of pure iron or the like and having a channel-like cross sectional shape, is disposed in the fluorescent display tube to be evaporated and activated with high-frequency heat to adsorb gas in the display tube so as to raise the degree of vacuum.

However, getter material of the foregoing type is enclosed in a large metal container, resulting in that the thickness and the size of the apparatus cannot easily be reduced if the getter material is used in the fluorescent display apparatus. In the foregoing case where the getter material is evaporated and activated with the high frequency heat, there is a fear that, for example, the conductive member, such as the gate electrode, is broken with the heat. If a conductive substrate, such as a silicon substrate, is employed to serve as the foregoing substrate, a similar fear arises.

SUMMARY OF THE INVENTION

The present invention has been suggested in view of overcoming the foregoing problems and objects of the present invention are as follows:

It is an object to provide a fluorescent display apparatus in which its fluorescent substance is not separated even if the electric-field electron discharge device and the fluorescent layer are allowed to come closer to each other in order to improve the resolution or to reduce the thickness and which is capable of satisfactorily performing display even if the display apparatus is adapted to low-speed electron beams and to provide a method of forming the fluorescent layer of the apparatus.

It is another object to provide a fluorescent display apparatus having a sealing member for sealing an exhaust port that does not outwardly project over the substrate as projected in the conventional structure and capable of maintaining the space between substrates at a satisfactory vacuum state and to provide a method of sealing vacuum in the space in the apparatus.

It is another object to provide a fluorescent display apparatus that can be provided with getter material while preventing occurrence of a problem at the time of reducing the thickness and the size of the apparatus and that is able to easily evaporate and activate the getter material and to provide a method of raising the degree of vacuum in the space in the apparatus.

A fluorescent display apparatus according to the present invention is characterized by a fluorescent display apparatus for performing a desired display by irradiating a fluorescent layer with electrons discharged from electric-field electron discharge devices, comprising at least a fluorescent substance and low-fusing-point glass serving as an adhesive agent that form said fluorescent layer. By including the low-fusing-point glass serving as the adhesive agent in the fluorescent layer, the fluorescent layer can be strongly held by a substrate or the like.

As the method of forming the foregoing fluorescent layer, paste obtained by mixing fluorescent substance powder, low-fusing-point glass powder and a binder may be applied to the substrate or the like, followed by drying the paste, and then sintering is performed at a temperature higher than a fusing point of the low-fusing-point glass so that the fluorescent layer is formed. As a result, a fluorescent display apparatus having the fluorescent layer strongly adhered by the substrate or the like can easily be manufactured.

The fluorescent display apparatus according to the present invention is characterized by a fluorescent display apparatus in which a device substrate having electric-field electron discharge devices and an opposing substrate having a fluorescent layer are held hermetically by an interposed member interposed in the peripheral portions of the two substrates at a predetermined interval, air between the two substrates is exhausted through an exhaust port formed in one of the substrates, followed by sealing vacuum in the space between the two substrates, and the fluorescent layer is irradiated with electrons discharged from the foregoing electric-field electron discharge devices to perform a desired display, wherein the foregoing exhaust port is sealed up with solder. By sealing the exhaust port with solder as described above, the excessive projection of the sealing member over the outer surface of the substrate can be prevented. Further, the space between the substrates can be satisfactorily maintained at a vacuum sealed state.

As the sealing method using solder as described above, when air between the two substrates is exhausted through the exhaust port formed in one of the substrates to seal up the space, said fluorescent display apparatus is placed on a frame in a vacuum chamber while allowing said exhaust port to face downwards, spherical solder is disposed between the frame and said exhaust port, air in the space between the foregoing two substrates is exhausted through a portion between said exhaust port and said solder to realize a vacuum state, and the solder is heated and melted to be injected into said exhaust port to seal up said exhaust port. As a result, the process for making a vacuum in the space between the substrates, and the space for sealing up the exhaust port can be continuously performed.

The fluorescent display apparatus according to the present invention is characterized in a fluorescent display apparatus in which a device substrate having electric-field electron discharge devices and an opposing substrate having a fluorescent layer are held hermetically by an interposed member interposed in the peripheral portions of the two substrates at a predetermined interval, a vacuum is formed in the space between the two substrates, and the fluorescent layer is irradiated with electrons discharged from the foregoing electric-field electron discharge devices to perform a desired display, wherein getter material for maintaining the vacuum state in the foregoing space is formed on the inner surface of the foregoing space to have a thin film shape. By forming the getter material for maintaining the vacuum state of the space between the two substrates on the inner surface of the foregoing space to have the thin film shape, the getter material can be disposed while preventing problems occurring at the time of reducing the thickness and the size of the apparatus.

In order to make the space in the apparatus have a vacuum by using the foregoing getter material, for example, the getter material is previously formed on the inner surface of the device substrate and/or the inner surface of the opposing substrate to form a thin film shape, the two substrates are held hermetically by an interposed member interposed in the peripheral portions of the foregoing two substrates at a predetermined interval, air in the foregoing space is exhausted, followed by sealing the space, and the foregoing getter material is irradiated with laser beams to be vaporized and activated. As a result, the getter material easily can be formed and activated, and breakage of conductive members such as the gate electrode can be prevented.

DETAILED DESCRIPTION OF PREFERRED EMBODIMENTS

Figure 1:
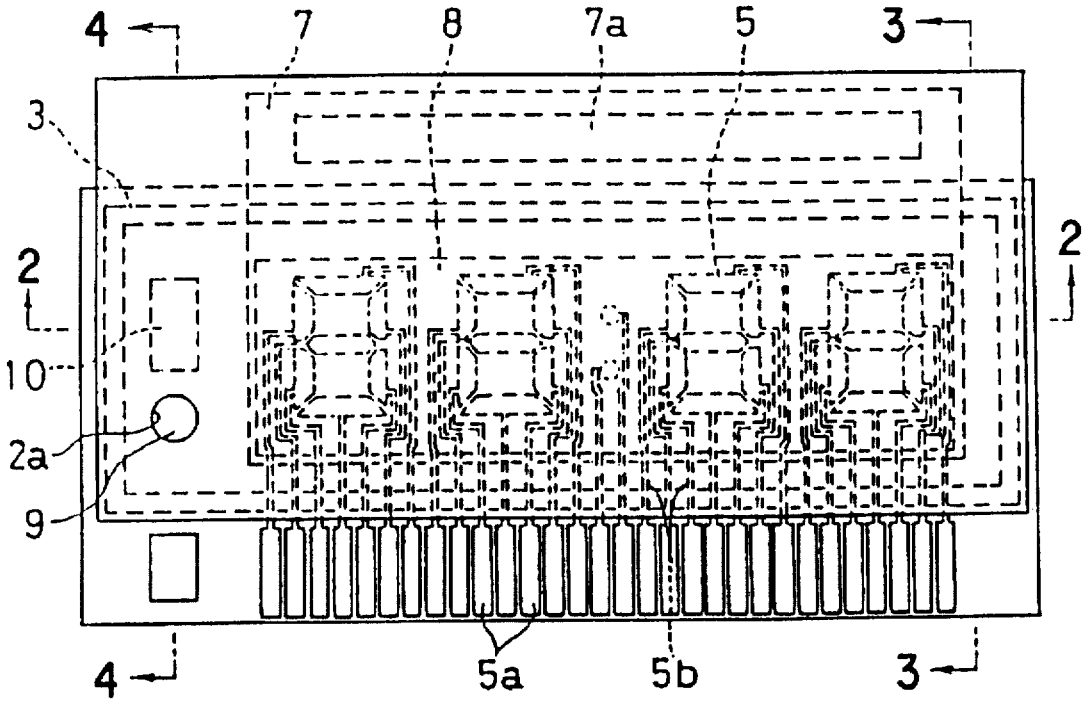
FIG. 1 is a plan view which illustrates an embodiment of a fluorescent apparatus according to the present invention.

With reference to embodiments shown in the drawings, a fluorescent display apparatus, a method of forming a fluorescent layer of the apparatus, a method of sealing vacuum in the space of the apparatus and a method of raising the degree of vacuum according to the present invention will now be described specifically.

Figure 2:
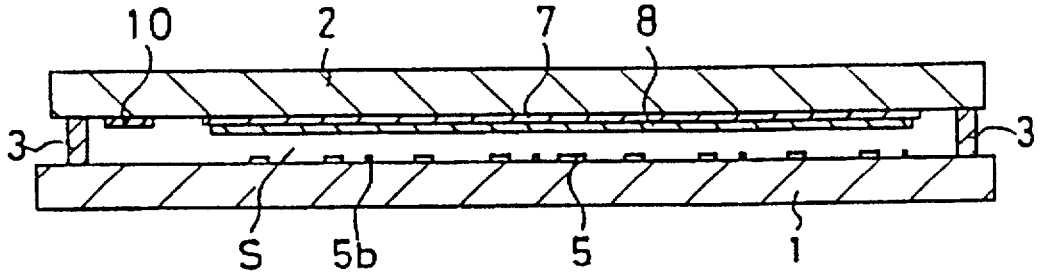
FIG. 2 is a cross sectional view taken along line 2—2 of FIG. 1.
Figure 3:
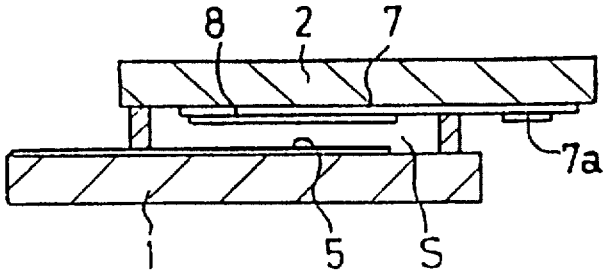
FIG. 3 is a cross sectional view taken along line 3—3 of FIG. 1.
Figure 4:
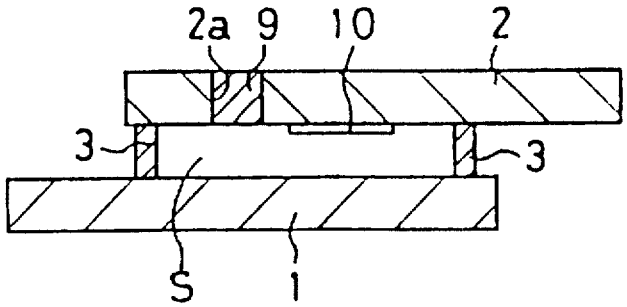
FIG. 4 is a cross sectional view taken along line 4—4 of FIG. 1.

FIG. 1 is a plan view which illustrates an embodiment of the fluorescent display apparatus according to the present invention, and FIG. 2, FIG. 3 and FIG. 4 respectively are cross sectional views taken along lines 2—2, 3—3 and 4—4 of FIG. 1. This embodiment is adapted to a character display for performing a clock display.

Referring to the drawings, reference numeral 1 represents a device substrate which is, in this embodiment, an n-type single crystal silicon substrate having a (100) plane orientation. opposing substrate 2 is disposed above the device substrate 1 at a predetermined interval to be substantially parallel with the device substrate 1. An interposed member 3 interposed between the two substrates 1 and 2 in a peripheral portion of the same enables them to be brought into contact and bonded to each other in a hermetic manner. Further, space S is formed between the two substrates 1 and 2 in a portion surrounded by the interposed member 3.

As for the material of the foregoing opposing substrate 2, it is preferable that material is used having a coefficient of thermal expansion which approximates that of the foregoing device substrate 1. In this embodiment, a transparent glass substrate ("#7740" manufactured by Corning) made of borosilicate glass is employed.

As for the material of the interposed member 3, it is preferable to employ material having the coefficient of thermal expansion which approximates those of the two substrates 1 and 2 in order to reduce stress after the foregoing two substrates 1 and 2 have been bonded to each other. In particular, it is preferable to use material that has the coefficient of thermal expansion which is an intermediate value of them. This embodiment uses a low-fusing-point powder glass having an a sintering of 450° C. and a coefficient of thermal expansion of $53 \times 10^{-7}$/° C.

It is preferable that a spacer or the like is mixed with the interposed member 3 in order to maintain the two substrates 1 and 2 at the parallel state. In this case, a spacer or the like must be selected that is not plasticized at the time of heating, melting and plasticizing the foregoing interposed member 3. In this embodiment, a spherical glass spacer is used which has a plasticization point that is higher than the foregoing sealing temperature. The particle size of the spacer must be at least larger than the thickness of a fluorescent layer 8 to be described later. In this embodiment, a spacer having a particle size of 60 μm is used so that the two substrates 1 and 2 are disposed at an interval of about 60 μm to run parallel to each other.

Figure 5:
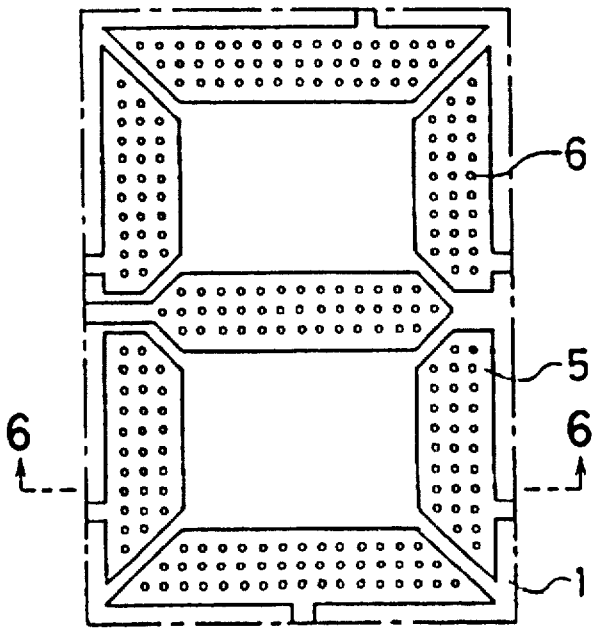
FIG. 5 is an enlarged plan view which illustrates a one-segment portion of the foregoing embodiment.
Figure 6:
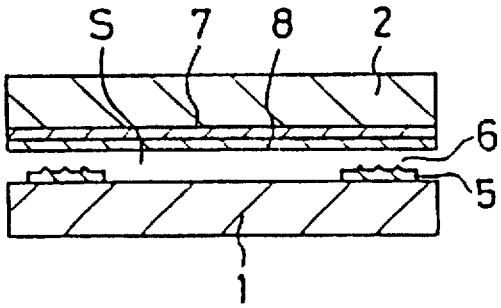
FIG. 6 is a cross sectional view taken along line 6—6 of FIG. 5.

A plurality of segment electrodes 5 disposed to display a clock are formed on the surface of the device substrate 1 in the foregoing space S, each segment electrode 5 having a plurality of electric-field electron discharge devices 6 serving as the electron discharge sources as shown in FIGS. 5 and 6. Reference numeral 5*a* represents a segment terminal 5*a* for connecting each of the foregoing segment electrodes 5 to an external circuit, each terminal 5*a* being formed on the surface of the insulating substrate 1 outside of the foregoing space S and connected to each of the foregoing segment electrodes 5 via segment wirings 5*b*.

Figure 7:
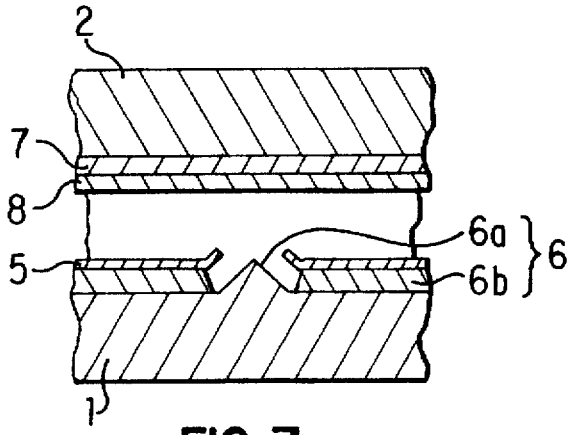
FIG. 7 is an enlarged view which illustrates an electric-field electron discharge device according to the foregoing embodiment.

The foregoing electric-field electron discharge devices 6 are, as shown in FIG. 7, each constituted by a substantially-conical projection 6*a* machined by an anisotropic etching method or the like, an insulating layer 6*b* formed on the surface of the device substrate 1 except for the portion adjacent to the projection 6*a* and made of a silicon-dioxide thin film or the like and a segment electrode (gate electrode) 5 formed on the surface of the insulating layer 6*b*, having an opening portion formed into a substantially circular shape at a position adjacent to the upper portion of the projection 6*a* and made of a molybdenum thin film or a tantalum thin film or the like.

It is preferable that the devise density of the foregoing electric-field electron discharge device 6 is $4\times10^4$ (devise/$cm^2$)or more. However, the foregoing devise density may be determined while considering the distance $d_{AK}$ (CM) from the electric-field electron discharge device 6 and the fluorescent layer 8 to be described later, the device density desired is $1/d_{AK}^2$ (device/$cm^2$) or more. In this embodiment, the electric-field electron discharge device 6 is formed at a rate of device/25 $\mu m^2$ so that about 1000 to 2000 electric-field electron discharge devices 6 are disposed.

The structure of the electric-field electron discharge device 6 is not limited to the foregoing embodiment. For example, a Spindt type structure as reported in JAP, Vol. 47 (1976) p. 5248 or a lateral type structure as reported in Technical Digest of IVMC '91 (1991) p. 46 or a structure as reported in the foregoing Technical Digest of IVMC '91 (1991) p. 26 and that can be manufactured by RIE and heat oxidation can be used.

On the other hand, an anode electrode 7 that is common to all segments on the foregoing device substrate 1 is formed on the surface of the opposing substrate 2 in the foregoing space S. The anode electrode 7 is made of an ITO thin film used in this embodiment and formed to have a thickness of 2000 angstroms. In the drawings, reference numeral 7*a* represents an anode terminal to be connected to an external circuit of the anode electrode 7. In this embodiment, a Cr-thin-film is formed on the anode electrode 7 projecting outwardly from the foregoing space S but the external circuit may be directly connected to the anode electrode 7 projecting outwardly from the foregoing space S.

The fluorescent layer 8 is formed on the surface of the foregoing anode electrode 7, the fluorescent layer 8 containing, in this embodiment, a low-fusing-point glass serving as an adhesive agent in a fluorescent substance thereof.

As the foregoing fluorescent substance, ZnO:Zn emitting green light is used in this embodiment. In addition, a mixture of ZnS:Cl and $In_2O_3$ which emits blue light or a mixture of ZnS:Ag and $In_2O_3$ which emits orange light may be used. By using plural kinds of the foregoing fluorescent substances, multi-color display or full-color display can be performed.

As for the low-fusing-point glass, it is preferable to employ one having the same coefficient of thermal expansion as that of the opposing substrate 2 which supports the foregoing fluorescent layer 8. For example, low-fusing-point glass having the coefficient of thermal expansion in a range from $20\times10^{-7}$/° C. to $90\times10^{-7}$/° C. is used. Specifically, frit glass (T436 made by Iwaki Glass Co., Ltd. or the like) or crystallized low-fusing-point glass or the like may be used. In this embodiment, the foregoing frit glass is used, the coefficient of thermal expansion of which is $60\times10^{-7}$/° C. and the sintering temperature of which is 450° C. An alkali metal silicate type inorganic adhesive agent or a phosphate-type inorganic adhesive agent may be used as the low-fusing-point glass.

The foregoing fluorescent layer 8 may be formed in such a manner that, for example, the powder fluorescent substance and the low-fusing-point glass are mixed with each other, and a binder is mixed to it to form paste material, and the paste is applied to the surface of the anode electrode 7 followed by drying and sintering it.

As the binder, an organic binder may be used. In this embodiment, the binder is prepared by mixing 2 to 5% nitrocellulose with butylcarbitol acetate.

As for the ratio of mixture of the foregoing fluorescent substance and the low-fusing-point glass, if the low-fusing-point glass is too small with respect to the fluorescent substance, the adhesive force is reduced. If the same is too large, the resistance is made excessively large or the display is darkened. Therefore, it is preferable that the low-fusing-point glass is 20 to 70 wt % with respect to the sum of the weight of the fluorescent substance and that of the low-fusing-point glass.

If the proportion of the binder is too small, the thickness is made thick when it is applied. If the same is too large, the thickness is made too thin. Therefore, it is necessary for the proportion to be adjusted arbitrarily while considering the thickness of the fluorescent layer 8 to be formed. When the thickness of the fluorescent layer 8 is made to be about 10 μm by using butyl-carbitol acetate, to which 3% nitrocellulose is mixed, as the binder, it is preferable that the proportion is about 20 to 80 wt % with respect to the sum of the weight of the fluorescent substance and that of the low-fusing-point glass.

Figure 8:
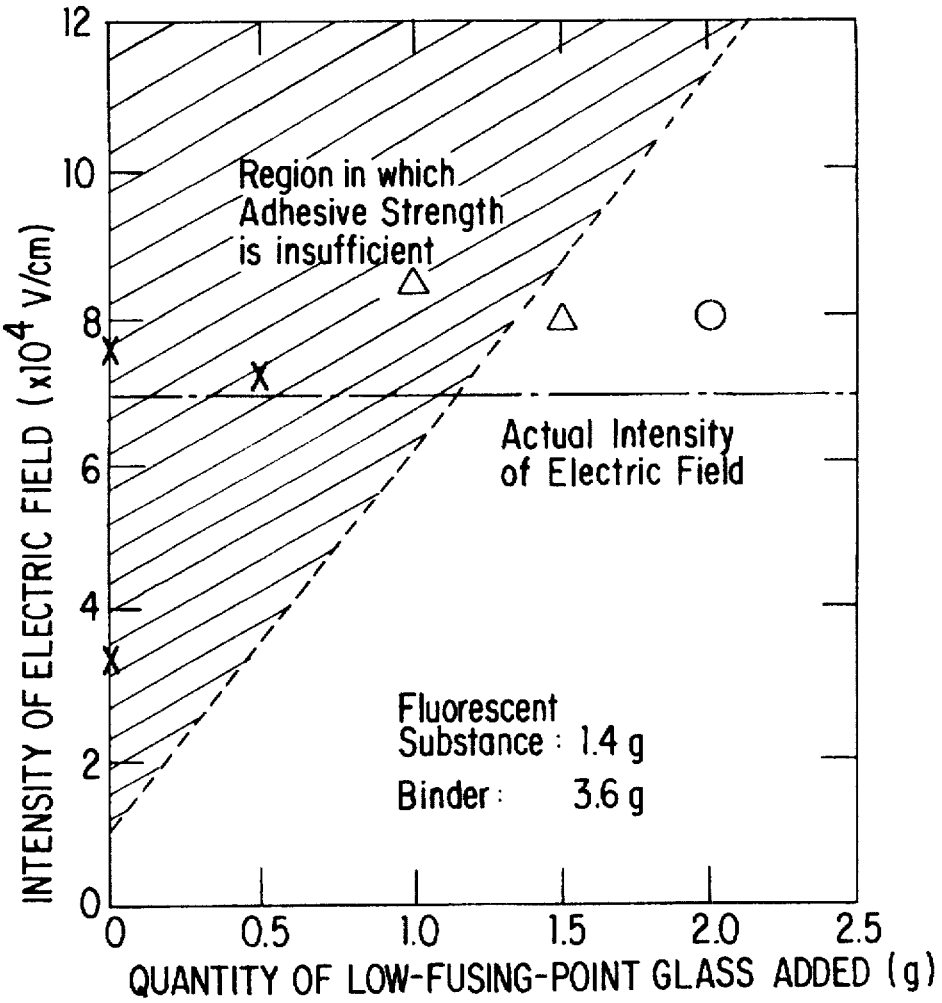
FIG. 8 is a graph showing the evaluation of adhesive strength with respect to the quantity of mixture of low-fusing-point glass.

FIG. 8 shows the result of an evaluation of the adhesive strength of the fluorescent layer with respect to the intensity of the electric-field when the quantity of mixture of the low-fusing-point glass is arbitrarily changed with respect to 1.4 g of the fluorescent substance and the fluorescent layer 8 is formed by adding 3.6 g of the binder. The actual intensity of the electric field in the vicinity of the electric-field electron discharge device 6 according to the foregoing embodiment was about $7\times10^4$ V/cm. It has been found that the quantity of mixture of the frit glass must be about 1.2 g or more in the foregoing case.

Figure 9:
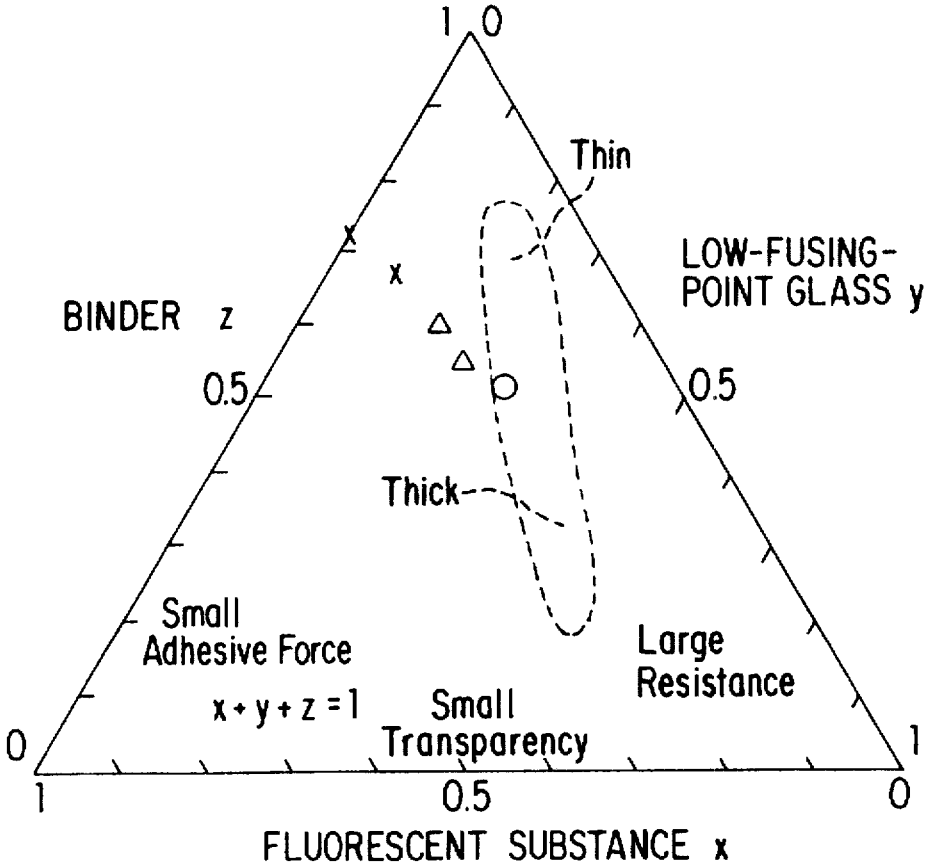
FIG. 9 is a graph which shows the optimum composition ratio of a fluorescent substance, low-fusing-point glass and a binder.

The proportion of the weight of the mixture of the foregoing fluorescent substance, the low-fusing-point glass and the binder and characteristics attained due to the mixture are shown in FIG. 9. FIG. 9 shows the result of an examination of the proportion in a case where x+y+z=1, assuming that the proportion of the fluorescent substance is x, the proportion of the low-fusing-point glass is y and the proportion of the binder is z. It has been found that a portion adjacent to mark 0 of FIG. 9 shows the most suitable proportion in which the proportion of the weight of the mixture of the foregoing fluorescent substance, the low-fusing-point glass and the binder x:y:z=0.2:0.29:0.51.

If the result is included in a region of the proportion of the weight of the mixture (x=0.05 to 0.30 wt %, y=0.15 to 0.55 wt % and z=0.15 to 0.80 wt %) designated by a dashed line, excellent adhesive strength is attained. The proportion of the mixture may be arbitrarily selected from the proportions included in the foregoing region while considering the transmittance and the conductivity.

Figure 10:
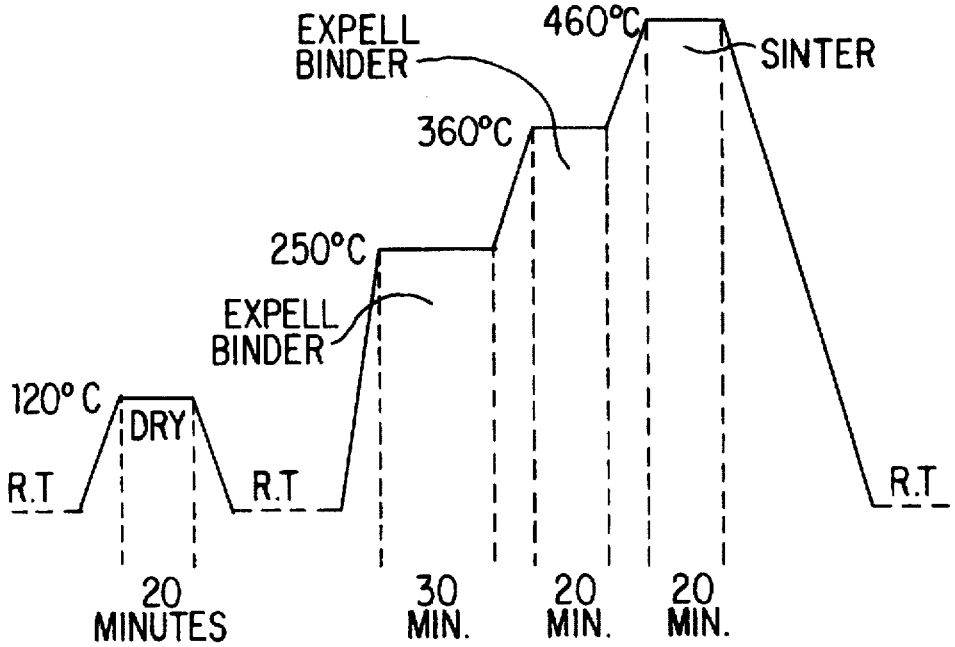
FIG. 10 is a graph which shows a schedule for forming a fluorescent layer.

When the fluorescent layer 8 was formed on the surface of the anode electrode 7 at the foregoing proportion of the weight of the mixture, it was satisfactorily in contact with the anode electrode 7 and it withstood electric fields stronger than $8\times10^4$ V/cm (400 V or more at a gap of 50 μm), resulting in sufficient practical level adhesive force to be obtained. A schedule of forming the fluorescent layer at this time is shown in FIG. 10.

A fluorescent display apparatus of the foregoing type must make the portion between the electric-field electron discharge device 6 and the fluorescent layer 8, that is the space S between the foregoing two substrates 1 and 2 to have a vacuum similar to the foregoing conventional example. An example of the structure for realizing the vacuum state and a method of sealing the vacuum state will now be described.

Referring to the foregoing FIGS. 1 and 4, reference numeral 2a represents an exhaust port 2a for exhausting air in the foregoing space S surrounded by the two substrates 1, 2 and the interposed member 3 to realize a vacuum state. The vacuum state is realized by exhausting air in the foregoing space S through the exhaust port 2a, followed by hermetically sealing the foregoing exhaust port 2a by a solder 9.

Figure 11:
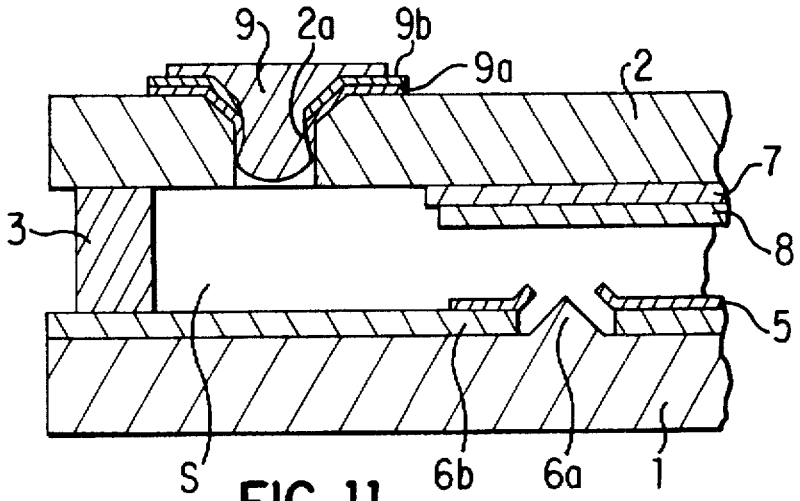
FIG. 11 is a cross sectional view which illustrates an example of a sealing structure for sealing an exhaust port with solder.

FIG. 11 illustrates an example of a state where the exhaust port 2a is sealed up with the solder 9 as described above, wherein the solder 9 is, from an outer position, embedded into the exhaust port 2a formed in the opposing substrate 2. As the solder 9, it is preferable to employ a Pb—Sn alloy. In this embodiment, a Pb—Sn alloy containing 37 wt % Pb is used.

By forming the outer opening portion of the foregoing exhaust port 2a into a funnel shape as illustrated, the area of contact with the solder 9 can be widened to enlarge the strength of the connection.

It is preferable to interpose an intermediate member between the opposing substrate 2 and the solder 9 if necessary in order to improve the contact between them. In this embodiment, a first intermediate member 9a made of Cr and a second intermediate member 9b made of an Au—Sn alloy containing Au by 80 wt % are sequentially interposed between the opposing substrate 2 and the solder 9.

Since the contact among the foregoing first intermediate member 9a made of Cr, the opposing substrate 2 and the second intermediate member 9b made of the Au—Sn alloy is excellent and the contact between the second intermediate member 9b and the foregoing solder 9 is excellent, the solder 9 can be strongly and hermetically brought into contact and fixed to the opposing substrate while interposing the intermediate members 9a and 9b.

Figure 12:
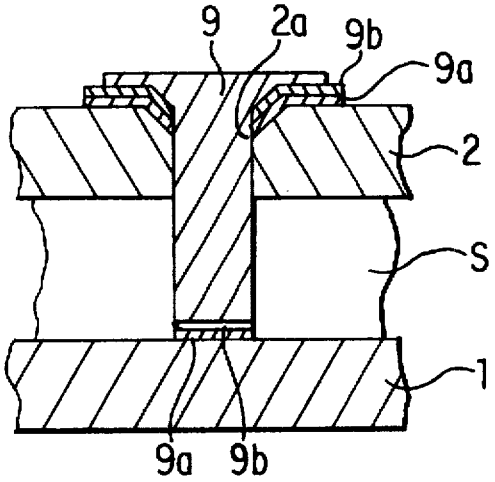
FIG. 12 is a cross sectional view which illustrates another example of the sealing structure for sealing the exhaust port with solder.

FIG. 12 is a cross sectional view which illustrates another specific example of a state where the exhaust port 2a is sealed up by the solder 9. This example is arranged so that the solder 9 is extended to the inner surface of the device substrate 1 opposing the foregoing opposing substrate 2. The intermediate members 9a and 9b similar to the foregoing structure are interposed between the device substrate 1 and the solder 9.

By extending the solder 9 to the inner surface of the device substrate 1 opposing the opposing substrate 2 as described above, the device substrate 1 and the opposing substrate 2 can be fixed further strongly while interposing the solder 9. As a result, pressure resistance can be improved when the space S between the two substrates 1 and 2 has been placed in a vacuum state and, accordingly, the difference between the external pressure and the internal pressure has been enlarged. Further, the solder 9 is enabled to also have a function as an interval-maintaining spacer between the two substrates 1 and 2.

In order to hermetically seal the exhaust port 2*a* with the solder 9 as described above, the following procedure may be employed for example.

First, the exhaust port 2*a* is previously formed in the opposing substrate 2 by, for example, an ultrasonic machine or the like. By first forming a hole in the surface, which is in contact with the space S, by using the ultrasonic machine or the like in this case, the end portion of the hole is made larger at the time of the completion of the formation of the hole. As a result, the funnel-like hole can inevitably be formed as shown in FIGS. 11 and 12.

Then, the intermediate members 9*a* and 9*b* are formed in the opening portion of the foregoing exhaust port 2*a* by evaporating or sputtering. If the formation is performed prior to coupling the two substrates 1 and 2 together, the intermediate members 9*a* and 9*b* can be formed in only the opposing substrate 2 as shown in FIG. 11. if the formation is performed after the two substrates 1 and 2 have been coupled together, the intermediate members 9*a* and 9*b* can be simultaneously formed in both opposing substrate 2 and the device substrate 1 as shown in FIG. 12.

Figure 13:
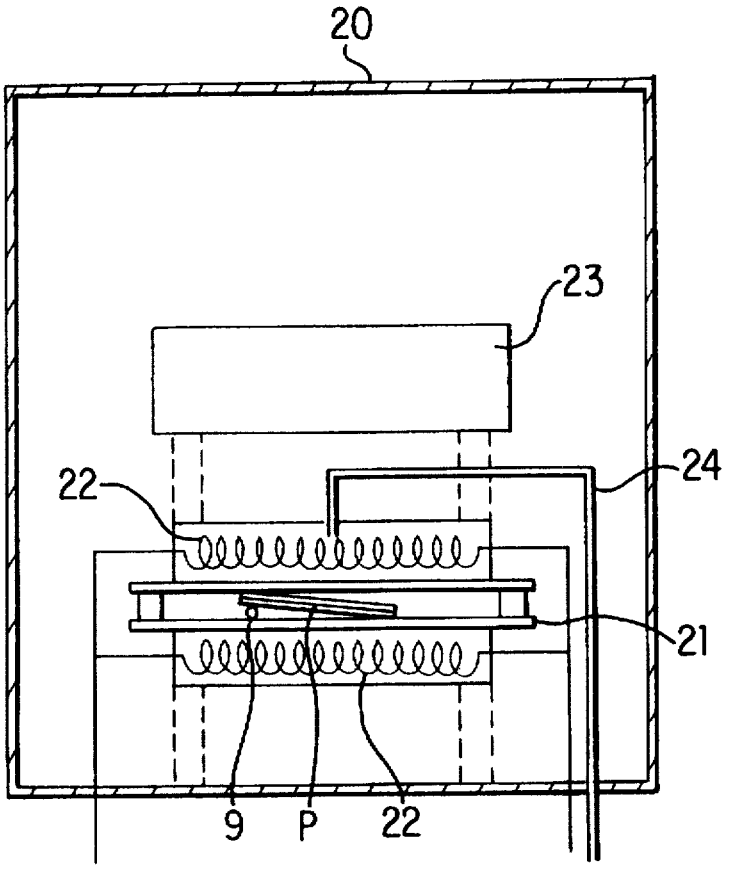
FIG. 13 is a vertical cross sectional view which illustrates a vacuum chamber.
Figure 14A:
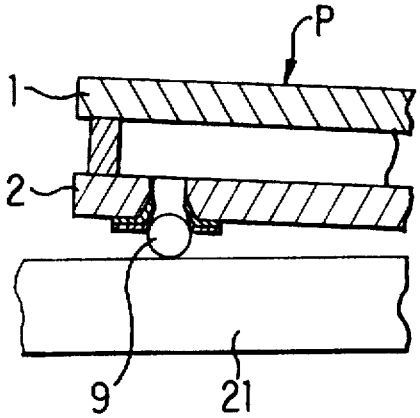
FIGS. 14A and 14B illustrate the procedure of sealing the exhaust port.
Figure 14B:
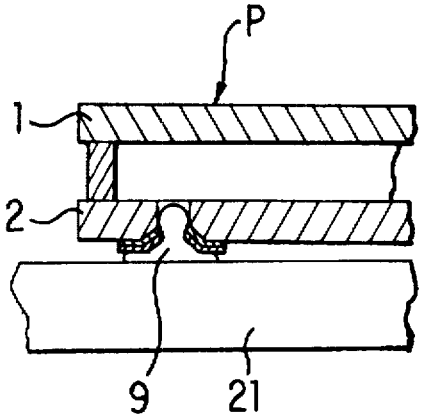

Finally, the space S between the two substrates 1 and 2 is placed in a vacuum state, and then the exhaust port 2*a* is sealed up with the solder 9. For example, a method may be employed in which a panel P obtained by integrating the two substrates 1 and 2 is placed on a frame 21 in a vacuum chamber 20 while causing the exhaust port 2*a* to face downwards as shown in FIG. 13, followed by the spherical solder 9 being disposed between the frame 21 and the foregoing exhaust port 2*a* as shown in FIG. 14A. Then, the space in the foregoing vacuum chamber 20 is made vacuum, and then air in the space S between the two substrates 1 and 2 is exhausted through a space between the exhaust port 2*a* and the solder 9 to realize vacuum. Then, a heater 22 is used to heat and melt the solder 9 to be injected into the foregoing exhaust port 2*a*. The solder 9 is then hardened so that the exhaust port 2*a* is sealed up as shown in FIG. 14B. Referring to FIG. 13, reference numeral 23 represents a weight and 24 represents a thermocouple.

Figure 15:
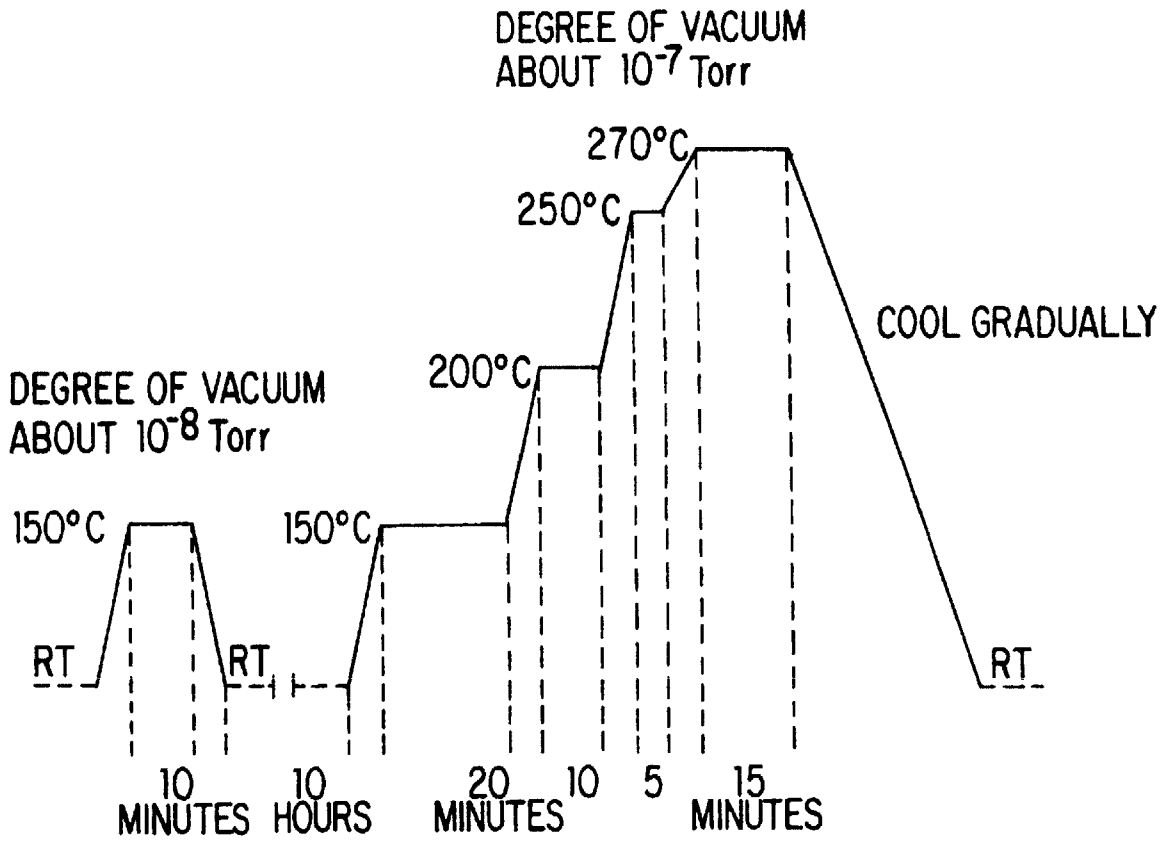
FIG. 15 illustrates the time schedule of a vacuum sealing process.

An example of a time schedule to be employed at the time of placing the space S between the two substrates 1 and 2 in a vacuum state and sealing up the exhaust port 2*a* with the solder 9 as described above is shown in FIG. 15.

By employing the foregoing method, the process for placing the space S between the foregoing two substrates 1 and 2 in a vacuum state and the process for sealing up the exhaust port 2*a* can be easily continuously performed. Further, the outer surface of the solder 9 can be made flat as shown in FIG. 14B with the dead weights of the two substrates 1 and 2 and the like.

Referring to FIGS. 1 and 2, reference numeral 10 represents a getter material which adsorbing residual gas in the foregoing space S and which is formed on the inner surface of the opposing substrate 2 by evaporation or the like to be formed into a thin film. After the space S has been placed in a vacuum state by exhausting, the foregoing getter material 10 is irradiated with laser beams to evaporate and activate it for the purpose of adsorbing the residual gas in the space S.

As the foregoing getter material, an AlMg alloy, an AlBa alloy, Ti, a Zr alloy or a Hf alloy may be employed. If the thickness of the getter material 10 is too thin, only an unsatisfactory effect of adsorbing the residual gas can be obtained. Therefore, it is preferable that the thickness is ranged from 1000 to 6000 angstroms. In this embodiment, an AlMg thin film containing Mg by 10% is used, the thickness of which is about 3000 angstroms. The area in which the getter material is formed may be widened to be adaptable to the size of the vacuum layer, the area being made to be 20 $mm^2$ in this embodiment.

Figure 16:
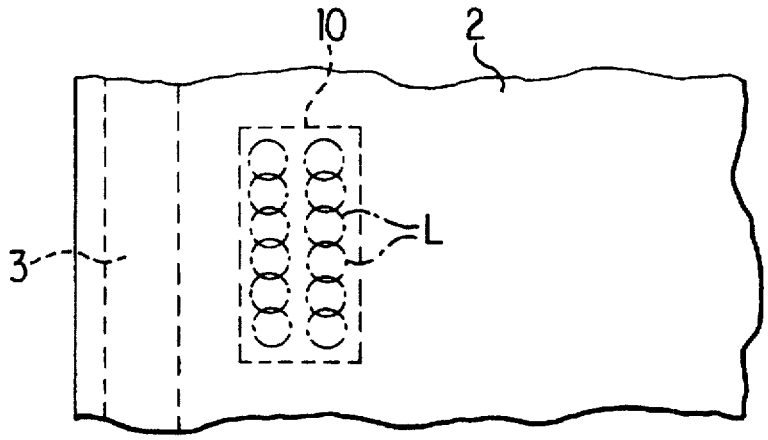
FIG. 16 is a plan view which illustrates an essential portion for explaining the procedure of irradiating getter material with laser beams.

When the foregoing getter material 10 is formed, it is previously formed on the opposing substrate by a vacuum evaporation method or the like prior to bonding the foregoing two substrates 1 and 2 to each other. Then, the two substrates 1 and 2 are bonded to each other, followed by placing the space S in a vacuum state. Then, laser beams L are applied to the getter material 10 from a position outside the opposing substrate 2 as designated by arrows of FIG. 17. For example, the laser beam irradiation is performed to sequentially form irradiation spots as designated with dashed lines of FIG. 16.

Figure 17:
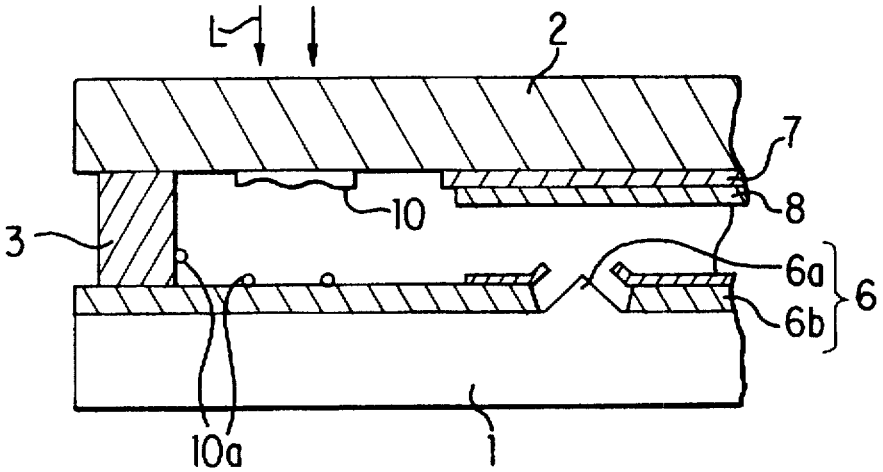
FIG. 17 is a cross sectional view which illustrates an essential portion of a state where the getter material is irradiated with laser beams.

When the getter material 10 is irradiated with the laser beams as described above, the getter material 10 is made of the getter fine grains 1O*a* as shown in FIG. 17 to be evaporated and flown so that the getter material 10 is activated and, accordingly, the residual gas in the space S is adsorbed. As a result, the degree of vacuum can be raised.

As the foregoing laser beam, YAG laser, $CO_2$ laser, Ar-ion laser, excimer laser or dye laser may be used.

It is preferable to perform bonding of the foregoing two substrates 1 and 2 in a vacuum space so that the degree of deterioration of the getter material due to oxidation or the like can be lowered.

Figure 18:
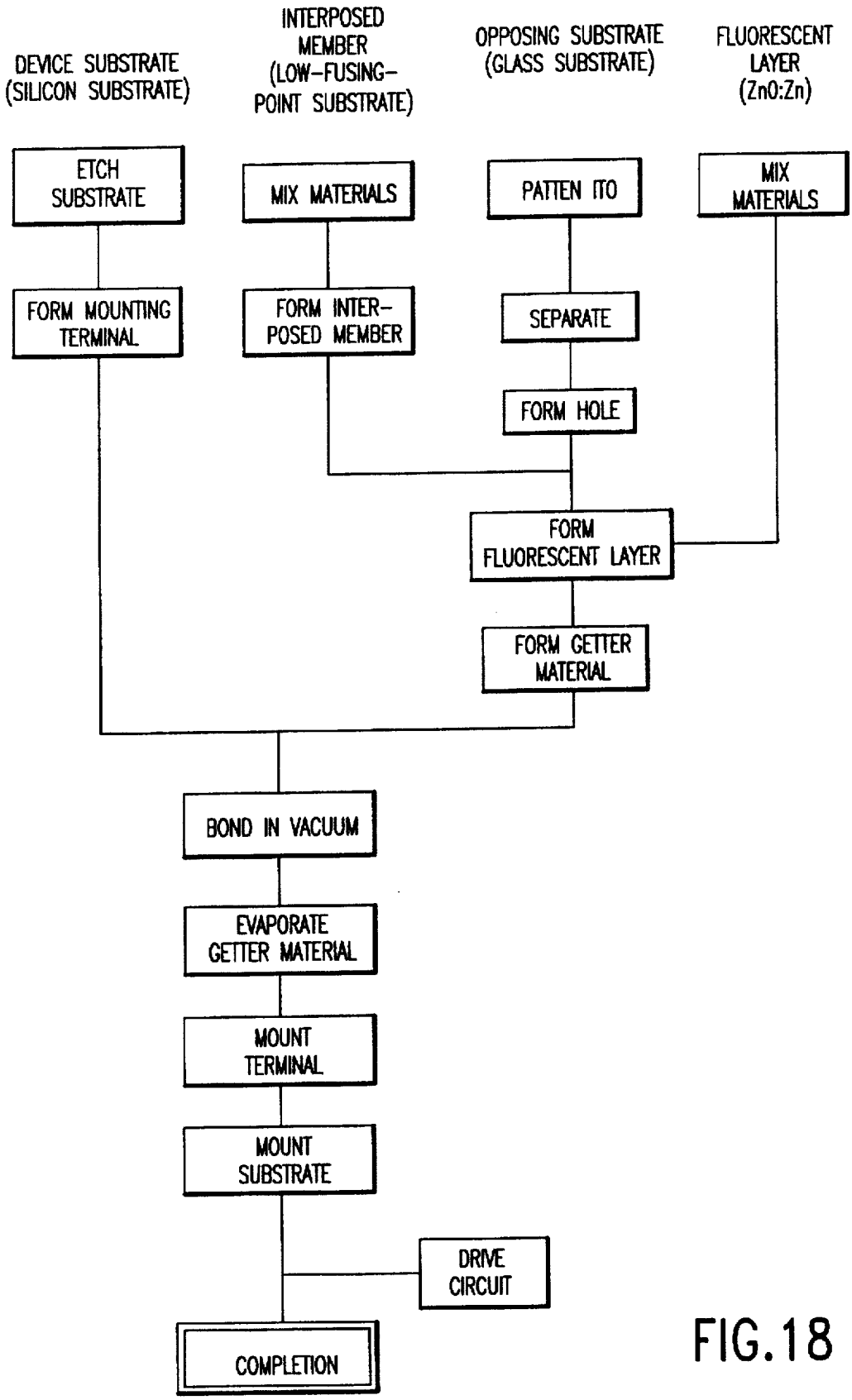
FIG. 18 is a flow chart which illustrates an example of the process of manufacturing the fluorescent display apparatus.

An example of a process for manufacturing the overall body of the foregoing fluorescent display apparatus will now be described with reference to a flow chart shown in FIG. 18.

First, the foregoing projection 6*a* shown in FIG. 7 is formed on the surface of the silicon substrate serving as the device substrate 1 by anisotropic etching. Further, the silicon dioxide thin film to be made into the insulating layer 6*b* and the tantalum thin film to be made into the segment electrode 5 are formed on the surface of the foregoing silicon substrate by a sputtering method. Then, a selective etching method is used to remove selectively the tantalum thin film and the silicon dioxide thin film formed above the projection 6*a* so that the projection 6*a* is exposed. The tantalum thin film is subjected to patterning to make the segment electrode 5, followed by forming, on each segment terminal 5*a*, a nickel thin film that can easily be soldered to form mounting terminals.

Since the foregoing tantalum thin film enables a stable tantalum oxide film (TaOx) to be easily formed on the surface thereof, disconnection occurring due to electrolytic etching that takes place in a contact portion with the interposed member 3 can be prevented. As a result, an advantage can be obtained in that a reliable wiring can be realized.

On the other hand, the ITO thin film to be made into the anode electrode 7 is formed on the glass substrate to serve as the opposing substrate 2, followed by subjecting it to patterning to have a predetermined shape. Then, the glass substrate is cut to have a desired size and shape so that the opposing substrate 2 having the anode electrode 7 on the surface thereof is formed. Then, a process for forming the hole in the glass substrate is performed to form the exhaust port 2a.

Further, the spherical glass spacer and the low-fusing-point powder glass are mixed with each other by using a fluid organic binder to be formed into fluid paste. The paste is, for example, screen-printed on the sealing portion in the periphery of the opposing substrate 2 so that the interposed member 3 is formed. The interposed member 3 is heated at 120° C. for 20 minutes for example to be dried in order to vaporize the organic binder solvent contained therein.

Then, the foregoing fluorescent substance and the low-fusing-point glass are mixed for application to the surface of the anode electrode of the foregoing opposing substrate 2 at a predetermined ratio as described above, followed by mixing the fluid organic binder so that the fluid paste is obtained. The fluid paste is applied by a screen-printing method or the like so that the fluorescent layer 8 is formed. In a structure capable of performing a multi-color display or a full-color display, fluorescent substances emitting three colors, red, green and blue are individually mixed with the low-fusing-point glass and the binder to perform the screen-printing three times.

Also the foregoing fluorescent-substance layer 8 is heated at, for example, 120° C. for about 20 minutes to be dried in order to vaporize the organic binder contained therein. Then, the temperature is gradually raised to, for example, about 340° C. to 450° C. so that the foregoing interposed member 3 is temporarily sintered and the florescent layer 8 is simultaneously sintered. Further, the getter material 10 is formed on the opposing substrate 2 by evaporating or the like.

Then, the opposing substrate 2 and the device substrate 1 having the foregoing electric-field electron discharge device 6 are aligned to each other, followed by making them face and run parallel while interposing the interposed member 3. The two substrates 1 and 2 are set in the vacuum chamber while applying a load.

In a state where the pressure has been lowered in the foregoing vacuum chamber, heating at a temperature lower than the sealing temperature is sufficiently performed to remove gas in order to exhaust and remove the residual gas and organic material in the foregoing space S through the exhaust port 2a. Then, the foregoing interposed member 3 is heated to, for example, 450° C. to be melted and sintered so that the two substrates 1 and 2 are hermetically vacuum-bonded to each other. Then, air in the foregoing space S is vacuum-exhausted through the foregoing exhaust port 2a, and then the foregoing exhaust port 2a is hermetically sealed up with the sealing member 9, such as solder. As a result, the foregoing space S is maintained at the vacuum state.

Finally, the foregoing two substrates 1 and 2 bonded as described above are ejected from the vacuum chamber, followed by irradiating the getter material 10 disposed on the surface of the opposing substrate 2 with the laser beams from a position outside of the foregoing opposing substrate 2 to raise the temperature of the getter material 10 which is evaporated and flown onto the surface of the foregoing device substrate 1 and the like, resulting in adsorbing the gas generated or left in the foregoing space S. As a result, the degree of vacuum is raised.

Each electrode formed as described above is subjected to a terminal mounting and substrate mounting processes, followed by connecting to a drive circuit. As a result, the fluorescent display apparatus is completed. The fluorescent display apparatus manufactured in this embodiment had a thickness of about 2 mm, and a size of 15 mm×25 mm, resulting in a very thin thickness, small size and reduced weight. The dimensions of its display portion were 12 mm×22 mm and its time-display portion composed of 7 segments was made to be 4 mm×2.5 mm.

In the foregoing process, the process for heating the foregoing interposed member 3 to be formed on the foregoing opposing substrate 2 at a temperature higher than the sealing temperature may be performed prior to performing the process for bonding the foregoing opposing substrate 2 and the foregoing device substrate 1 to each other in the vacuum state while interposing the interposed member 3. By heating the interposed member 3 at a temperature higher than the fusing point in the vacuum state as described above, the gas and organic material and so forth contained in the foregoing interposed member 3 are removed to prevent generation of gas at the time of performing sealing. Therefore, a fluorescent display apparatus exhibiting an excellent degree of vacuum and airtightness can be realized. A process for irradiating the opposing substrate 2 or the device substrate 1 with light in a vacuum state to remove gas may be performed prior to performing the process for bonding the foregoing opposing substrate 2 and the foregoing device substrate 1 to each other in the vacuum state while interposing the interposed member 3. By irradiating the surface of each substrate with light in the vacuum state as described above while using a mercury lamp, a halogen lamp or laser beams including ultraviolet rays as the light source, gas molecules and organic material and so forth adhered to the surface of the substrate are activated and removed so that the surface is cleaned up. In particular, it is effective to clean the surface of the projection 6a of the electric-field electron discharge device 6. The foregoing light irradiation process causes effects of uniform and low threshold voltage and enabling the stability of the discharged current to be improved. As a result, a reliable fluorescent display apparatus can be obtained.

The fluorescent display apparatus manufactured as described above is operated by applying gate voltage $V_{GK}$ having positive potential to the segment electrode 5 serving as the gate electrode with respect to the foregoing projection 6a serving as the cathode electrode to apply an intense electric field to a portion adjacent to the leading portion of the projection 6a. As a result, electrons are discharged into the foregoing vacuum space S from the portion adjacent to the projection 6a due to the tunnel effect. Discharged electrons are then accelerated with positive-potential anode voltage $V_{AK}$ applied to the anode electrode 7 and are applied and injected into the fluorescent layer 8. As a result, the fluorescent layer 8 is excited so that the fluorescent substance in the fluorescent layer 8 emits light. As a result, a desired display can be performed.

At this time, electrons emitted from the foregoing projection 6a are distributed in the form of an inversecone, the vertex of which is the leading portion of the projection 6a. As a result, electrons are applied to the surface of the fluorescent layer 8 in a circular pattern, the radius of which is substantially $d_{AK}$. Anode electric current $I_{AK}$ to be introduced into the fluorescent layer 8 at this time is controlled with $V_{GK}$ when $V_{AK} >> V_{GK}$. Anode electric current $I_{AK}$ per electric-field electron discharge device was $I_{AK}=5\times10^{-10}$ A ($V_{AK}$=200 V) when $V_{GK}$=70 V.

When the anode voltage is lowered to a level similar to or lower than the gate voltage, discharged electrons also flow to the gate electrode, resulting in an increase in reactive currents. In order to prevent this, it is preferable to set the voltage to satisfy $V_{AK} > 2\ V_{GK}$.

Although the foregoing embodiment comprises the exhaust port formed in the opposing substrate 2 to exhaust air in the foregoing space S, the foregoing exhaust port may be formed in the device substrate 1 or in both substrates. Air may be exhausted at the time of sealing up the device substrate 1 and the opposing substrate 2 while interposing the interposed member 3. For example, the interposed member 3 is formed on one of the foregoing two substrates 1 and 2, followed by stacking the residual substrate at a temperature lower than the sealing temperature for the interposed member 3. As a result, small projections and pits in the surface of the interposed member 3 create a gap from the foregoing residual substrate and the interposed member 3. By injecting it into the vacuum chamber or the like, air in the foregoing space is exhausted through the foregoing gap. In this state, the temperature is required to be raised to a level higher than the sealing temperature to seal and plug the foregoing gap.

Figure 19:
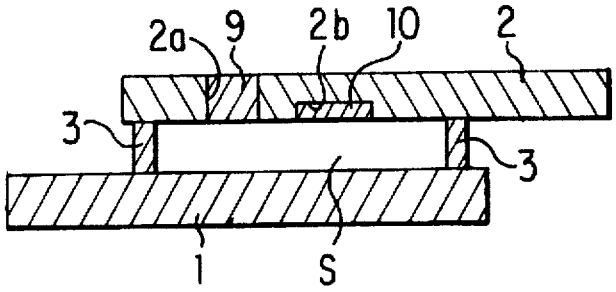
FIG. 19 is a cross sectional view which illustrates an example in which the getter material is embedded in a recess formed in an opposing substrate.

Although the foregoing embodiment comprises the getter material 10 formed on the inner surface of the opposing substrate 2 by evaporating or the like, it may be formed on the device substrate. Furthermore, it may be formed by another means such as sputtering as well as evaporating. For example, a recess **2*b* may be formed in the opposing substrate 2 as shown in FIG. 19 to embed the getter material 10** into the foregoing recess.

Figure 20:
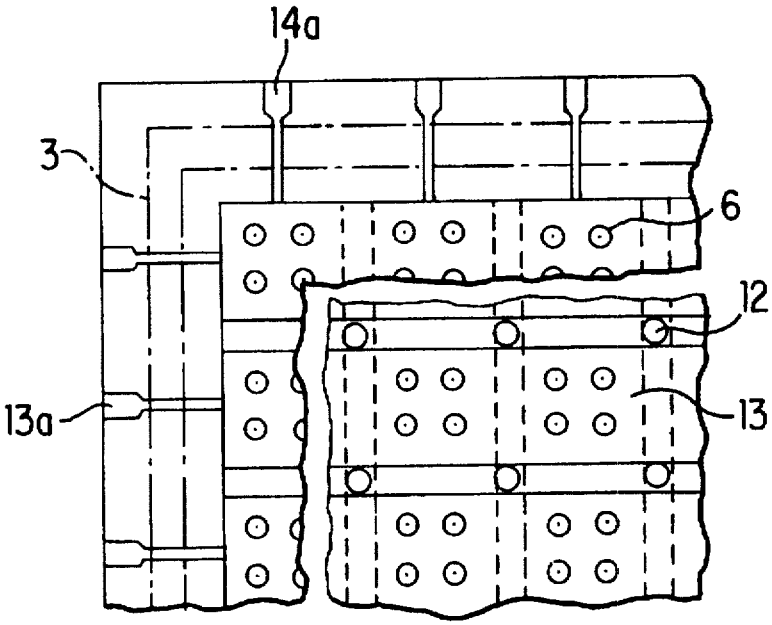
FIG. 20 is a plan view which illustrates an essential portion for explaining another embodiment of the fluorescent display apparatus according to the present invention.
Figure 21:
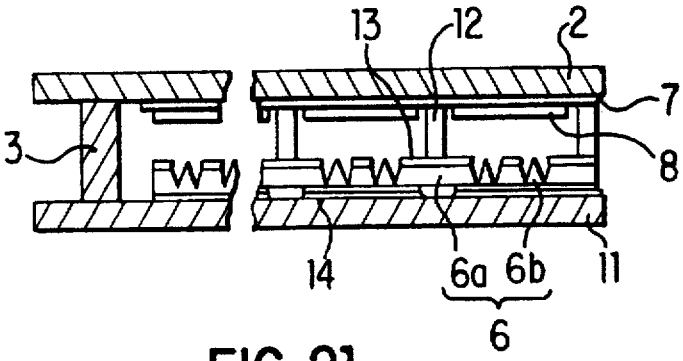
FIG. 21 is a vertical cross sectional view which illustrates the foregoing other embodiment.
Figure 22:
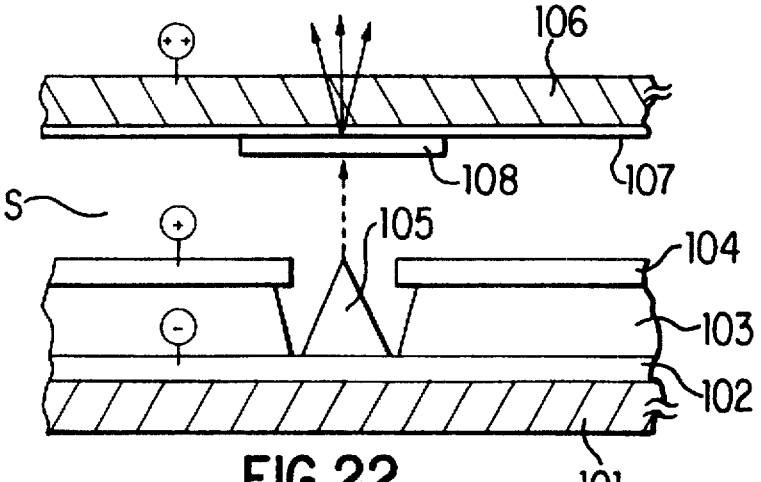
FIG. 22 PRIOR ART
FIG. 22 is a vertical cross sectional view which illustrates a conventional fluorescent display apparatus.
Figure 23:
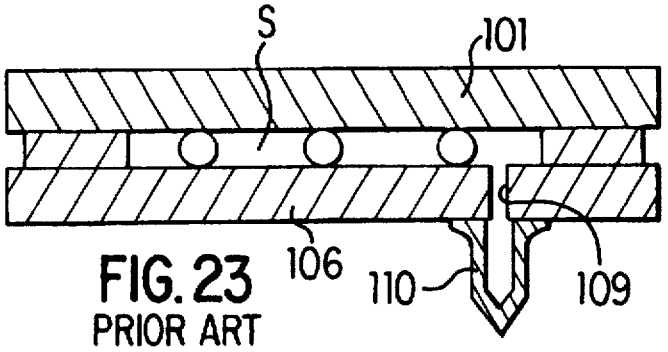
FIG. 23 PRIOR ART
FIG. 23 is a schematic vertical cross sectional view which illustrates a conventional vacuum sealing structure.
Figure 24A:
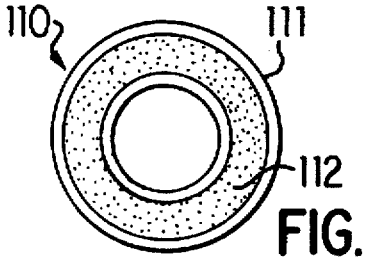
FIG. 24A PRIOR ART
FIGS. 24A and 24B respectively are a plan view and a cross sectional view which illustrate conventional getter material.
Figure 24B:
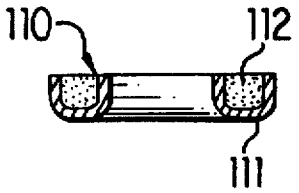
FIG. 24B PRIOR ART

Although the foregoing embodiment is adapted to a 7-segment-type character display for clock display, it may be adapted to another fluorescent display apparatus. FIGS. 20 and 21 illustrate an example in which the embodiment is adapted to a matrix-type fluorescent display apparatus.

Referring to the drawings, reference numeral 11 represents a matrix-device substrate comprising a silicon substrate or the like, the substrate 11 having the electric-field electron discharge device 6 arranged similarly to the foregoing embodiment. The electric-field electron discharge device 6 is not limited to the foregoing structure. It may be a spindt-type device formed on a glass substrate or a lateral-type device. On the other hand, an ITO thin film 7 to serve as the anode electrode and made of conductive material is formed on the opposing substrate 2. The fluorescent layer 8, which emits fluorescent color, is formed on the ITO thin film 7.

The foregoing matrix-device substrate 11 and the foregoing opposing substrate 2 are bonded to each other by means of the interposed member 3, the two substrates being maintained at a predetermined interval by a spacer 12 manufactured by a photoprocess. As the spacer 12, SiOx or the like prepared by a spin coating method is used, the spacer 12 being formed into a columnar shape as shown in FIG. 21 on a stripe gate electrode 13 in which no electric-field electron discharge device 6 is present and on the insulating layer **6*b* in which no stripe cathode electrode 14** is present.

Further, a gate wiring **13*a* of the foregoing stripe gate electrode 13 for connecting to an external circuit and a cathode wiring 14*a* of the foregoing stripe cathode electrode 14 are formed in the outer periphery of the foregoing matrix-device substrate 11**.

The matrix-type fluorescent display apparatus of the foregoing type is utilized as, for example, a color view finder of a cam corder.

Also the fluorescent layer 8 of the foregoing embodiment may have the structure and may be formed by a method which are similar to those of the foregoing embodiment. Also in the foregoing embodiment, the space S between the two substrates 11 and 2 is placed in a vacuum state. In this case, an exhaust port may be formed in either of the substrates similar to the foregoing embodiment although omitted from illustration, and sealed up with solder. Also in this case, getter material similar to that of the foregoing embodiment may be disposed on the inner surface of the substrate so as to be irradiated with laser beams to raise the degree of vacuum.

As described above, according to the present invention, the fluorescent display apparatus for performing a desired display by irradiating the fluorescent layer 8 with electrons discharged from the electric-field electron discharge devices has an arrangement that the foregoing fluorescent layer 8 is formed by at least the fluorescent substance and the low-fusing-point glass serving as the adhesive agent for the fluorescent substance, that is, the fluorescent layer contains the low-fusing-point glass serving as the adhesive agent. Therefore, the fluorescent layer 8 can be strongly held by the substrate 1 or the like. As a result, a fluorescent display apparatus exhibiting satisfactory durability can be provided.

When the foregoing fluorescent layer is formed, for example, paste obtained by mixing the fluorescent substance powder, the low-fusing-point glass powder and the binder may be applied to the substrate or the like, followed by drying the paste, and then sintering is performed at a temperature higher than the fusing point of the foregoing low-fusing-point glass. Therefore, the fluorescent layer easily can be formed.

The fluorescent display apparatus in which a device substrate 1 having electric-field electron discharge devices 6 and an opposing substrate 2 having a fluorescent layer 8 are held hermetically by an interposed member 3 interposed in the peripheral portions of the two substrates 1 and 2 at a predetermined interval, air between the two substrates 1 and 2 is exhausted through an exhaust port **2*a* formed in at least the substrate 2, followed by sealing vacuum in the space S between the two substrates 1 and 2, and the fluorescent layer 8 is irradiated with electrons discharged from the foregoing electric-field electron discharge devices 6** to perform a desired display, wherein the foregoing exhaust port is sealed up with solder. As a result, the excessive projection of the sealing member over the outer surface of the substrate experienced with the foregoing conventional structure can be prevented. Further, the space between the substrates can be satisfactorily maintained at the vacuum state.

According to the foregoing vacuum sealing method of the present invention, the process for forming a vacuum in the space between the substrates and the process for sealing the exhaust port **2*a*** can be easily continuously performed.

As described above, the fluorescent display apparatus according to the present invention comprises the getter material for maintaining the vacuum state in the space between the two substrates which is formed on the inner surface of the foregoing space to have a thin film shape as described above. Therefore, the getter material can be disposed in the foregoing space while preventing a problem at the time of thinning the thickness and reducing the size of the apparatus.

The method of realizing a vacuum state in the apparatus is arranged so that the getter material is previously formed on the inner surface of the foregoing space to have a thin film shape and it is irradiated with laser beams to be vaporized and activated. Therefore, the getter material can easily be vaporized and activated. Further, a fear of breakage caused from excessive heat can be eliminated as experienced with the foregoing conventional high frequency heating method even if the gate electrode is made of a conductive member and if the conductive substrate such as the device substrate is used as the substrate. Therefore, effects can be obtained in that the reliability of the foregoing type fluorescent display apparatus can be improved.

What is claimed is:

1. A fluorescent display apparatus, comprising:

a first substrate having at least one cathode formed on a surface thereof, each cathode having a plurality of electric-field electron discharge devices for discharging low-speed electrons;

a second substrate opposed to said first substrate, said second substrate having at least one anode formed thereon and a fluorescent layer comprising a fluorescent substance and a low-fusing-point glass formed on said anode, said cathode and said anode being located at a distance such that an electrostatic attractive force between said electric-field electron discharge devices and said fluorescent layer is greater than the Van der Waals force between said anode and said fluorescent substance, said fluorescent layer having a sufficient quantity of low-fusing-point glass such that said fluorescent layer is prevented from separating from said second substrate in response to the electrostatic attractive force between said electric-field electron discharge devices and said fluorescent layer when a voltage is applied between said cathode and said anode; and at least one spacer member interposed between said first and second substrates to define and maintain a space therebetween, whereby, low-speed electrons discharged from said cathode are absorbed by said fluorescent layer and cause said fluorescent layer to emit light.

2. A fluorescent display apparatus according to claim 1, wherein said low-fusing-point glass comprises from 20 to 70 weight % of the sum of the weights of said fluorescent substance and said low-fusing-point glass.

3. A fluorescent display apparatus according to claim 1, wherein the coefficient of thermal expansion of said low-fusing-point glass is substantially the same as the coefficient of thermal expansion of said second substrate.

4. A fluorescent display apparatus according to claim 1, wherein the coefficient of thermal expansion of said low-fusing-point glass is in the range of from approximately $20\times10^{-7}/°$ C. to $90\times10^{-7}/°$ C.

5. A fluorescent display apparatus according to claim 1, wherein the device density of said electric-field electron discharge devices of said display apparatus is at least $1/d_{AK}^2$, where $d_{AK}$ is the distance from said electric-field electron discharge device to said fluorescent layer.

6. A fluorescent display apparatus according to claim 1, wherein said fluorescent substance is selected from the group consisting of ZnO:Zn, a mixture of ZnS:Cl and $In_2O_3$ and a mixture of ZnS:Ag and $In_2O_3$.

7. A fluorescent display apparatus according to claim 1, wherein said fluorescent layer is comprised of said fluorescent substance, said low-fusing-point glass and a binder, and wherein said fluorescent layer has a mixture ratio prior to a sintering operation such that said fluorescent substance comprises approximately 5 to 30 wt. %, said low-fusing-point glass comprises approximately 15 to 55 wt. % and said binder comprises approximately 15 to 80 wt. % of said fluorescent layer.

8. A fluorescent display apparatus according to claim 7, wherein said fluorescent layer has a mixture ratio such that said fluorescent substance comprises approximately 20 wt. %, said low-fusing-point glass comprises approximately 29 wt. %, and said binder comprises approximately 51 wt. % of the fluorescent layer.

9. A fluorescent display apparatus according to claim 1, further comprising:

an exhaust port formed in one of said first and second substrates for exhausting gas from said space to the exterior of the display apparatus; and a sealing member for sealing said exhaust port.

10. A fluorescent display apparatus according to claim 9, wherein said sealing member comprises solder.

11. A fluorescent display apparatus according to claim 1, wherein at least one of said first and second substrates has at least one recess formed therein, and further comprising a thin film of getter material disposed in said recess and contacting said space.

12. A fluorescent display apparatus according to claim 1, wherein said low-fusing-point glass is frit glass.

13. A fluorescent display apparatus according to claim 1, wherein said low-fusing-point glass is an alkali metal silicate type inorganic adhesive agent.

14. A fluorescent display apparatus according to claim 1, wherein said low-fusing-point glass is a phosphate-type inorganic adhesive agent.

15. A fluorescent display apparatus, comprising:

first and second parallel opposed substrates;

a plurality of cathodes formed on a surface of said first substrate, each cathode having a plurality of electric-field electron discharge devices for discharging low-speed electrons;

an anode formed on a surface of said second substrate;

a fluorescent layer formed on a surface of said anode, said fluorescent layer comprising a fluorescent substance and a low-fusing-point glass, said plurality of cathodes and said anode being located at a distance such that an electrostatic attractive force between said electric-field electron discharge devices and said fluorescent layer is greater than the Van der Waals force between said anode and said fluorescent substance, said fluorescent layer having a sufficient quantity of low-fusing-point glass such that said fluorescent layer is prevented from separating from said second substrate in response to the electrostatic attractive force between said electric-field electron discharge devices and said fluorescent layer when a voltage is applied between said plurality of cathodes and said anode;

at least one spacer member interposed between said first and second substrates to define a space therebetween;

an exhaust port formed in one of said first and second substrates for exhausting gas from said space; and a sealing member for sealing said exhaust port.

16. A fluorescent display apparatus according to claim 15, wherein an intermediate member is interposed between said exhaust port and said sealing member.

17. A fluorescent display apparatus according to claim 16, wherein said intermediate member further comprises a first layer and a second layer sequentially interposed between said exhaust port and said sealing member.

18. A fluorescent display apparatus according to claim 17, wherein said first layer comprises Cr and said second layer comprises an Au—Sn alloy.

19. A fluorescent display apparatus according to claim 15, wherein said exhaust port comprises a funnel shaped opening.

20. A fluorescent display apparatus, comprising:

a pair of parallel opposed substrates, at least one of said pair of substrates having at least one recess formed therein;

a plurality of cathodes formed on a surface of one of said pair of substrates, each cathode having a plurality of electric-field electron discharge devices for discharging low-speed electrons;

an anode formed on a surface of the other of said pair of substrates;

a fluorescent layer formed on said anode, said fluorescent layer having at least a fluorescent substance and a low-fusing-point glass, said plurality of cathodes and said anode being located at a distance such that an electrostatic attractive force between said electric-field electron discharge devices and said fluorescent layer is greater than the Van der Waals force between said anode and said fluorescent substance, said fluorescent layer having a sufficient quantity of low-fusing-point glass such that said fluorescent layer is prevented from separating from said second substrate in response to the electrostatic attractive force between said electric-field electron discharge devices and said fluorescent layer when a voltage is applied between said plurality of cathodes and said anode;

at least one spacer member interposed between said pair of substrates to define a space therebetween; and a thin film of getter material disposed in said recess and contacting said space.

21. A fluorescent display apparatus according to claim 20, wherein the thickness of said thin film of getter material is in a range from approximately 1000 to 6000 angstroms.

22. A fluorescent display apparatus according to claim 20, wherein said getter material is made of a material selected from the group consisting of AlMg alloy, AlBa alloy, Ti, a Zr alloy and Hf alloy.

* * * * *